US007757621B2

(12) United States Patent
Breivik et al.

(10) Patent No.: US 7,757,621 B2
(45) Date of Patent: Jul. 20, 2010

(54) VESSEL FOR TRANSPORT OF COMPRESSED NATURAL GAS

(75) Inventors: Kåre Breivik, Tau (NO); Hugo Gustavsen, Kleppestø (NO); Peter Jenkins, Oslo (NO); Raymond Heggholmen, Bergen (NO)

(73) Assignee: Compressed Energy Technology A/S, Sandvika (NO)

( * ) Notice: Subject to any disclaimer, the term of this patent is extended or adjusted under 35 U.S.C. 154(b) by 199 days.

(21) Appl. No.: 11/988,302

(22) PCT Filed: Jul. 5, 2006

(86) PCT No.: PCT/NO2006/000256

§ 371 (c)(1),
(2), (4) Date: Mar. 25, 2008

(87) PCT Pub. No.: WO2007/004896

PCT Pub. Date: Jan. 11, 2007

(65) Prior Publication Data

US 2009/0114142 A1 May 7, 2009

(30) Foreign Application Priority Data

Jul. 6, 2005 (NO) ..... 20053844

(51) Int. Cl.
*B63B 25/08* (2006.01)

(52) U.S. Cl. ..... 114/74 R; 114/74 A

(58) Field of Classification Search ..... 114/74, 114/74 R, 74 A

See application file for complete search history.

(56) References Cited

U.S. PATENT DOCUMENTS

| | | | | |
|---|---|---|---|---|
| 2,537,085 | A | 1/1951 | Phelps | |
| 3,830,180 | A | 8/1974 | Bolton | |
| 6,481,751 | B1 * | 11/2002 | Davis et al. | 280/831 |
| 2007/0095427 | A1 * | 5/2007 | Ehrhardt et al. | 141/387 |

FOREIGN PATENT DOCUMENTS

| | | | |
|---|---|---|---|
| WO | WO-97/16678 | A1 | 5/1997 |
| WO | WO-00/57102 | A1 | 9/2000 |
| WO | WO-00/73134 | A1 | 12/2000 |
| WO | WO-02/066316 | A1 | 8/2002 |

* cited by examiner

*Primary Examiner*—Stephen Avila
(74) *Attorney, Agent, or Firm*—Birch, Stewart, Kolasch & Birch, LLP

(57) ABSTRACT

Vessel comprising a number of composite storage tanks for transport of compressed natural gas (CNG) or a combination of gas and liquid, which tanks have an elongated, cylindrical intermediate section and a lower end and an upper end, the tanks being arranged side-by-side vertically standing in the vessel, distinguished in that the hull, the bulkheads and the deck of the vessel form a closed space enveloping all tanks except from the upper end of each tank or selected tanks, for which tanks the upper end extends sealingly out of the closed space, all feed-throughs in the tanks with couplings for loading and unloading are outside of the closed space, at the upper end of the tanks, and the tanks are supported such that each tank can expand or contract freely within the operating range of the tanks with respect to pressure and temperature.

9 Claims, 6 Drawing Sheets

VESSEL FOR TRANSPORT OF COMPRESSED NATURAL GAS

FIELD OF THE INVENTION

The present invention relates to a vessel for transport of compressed natural gas, with or without a content of liquid unprocessed or partly processed well stream. More particularly, the present invention relates to a vessel comprising a number of composite storage tanks for transport of compressed natural gas or gas and liquid, which tanks have a cylindrical intermediate section and a lower end and an upper end, and the tanks are arranged side-by-side vertically standing in the vessel.

BACKGROUND OF THE INVENTION AND PRIOR ART

It is known that compressed natural gas can be transported on a vessel equipped with tanks formed as cylinders, which tanks are prepared from special steel. Also known are vessels for transport of compressed natural gas, comprising tanks in the form of high-pressure steel pipes, arranged either along the longitudinal axis of the vessel or as coils on-board the vessel. For vessels having tanks prepared from steel it can however be a significant problem that the load constitutes a relatively small part of the total weight of the vessel, which means a high cost of transportation. It is known that use of composite tanks can be preferable, because of possibility for significantly reduced weight of the tanks per se. A composite tank can preferably be prepared by starting with a high-density polyethylene (HDPE) diffusion barrier innermost in the tank, outside which diffusion barrier an adhesive impregnated glass- or carbon fibre winding is arranged to increase strength. The windings are made in a spiral pattern with pre-tensioning of the fibers. The end sections of such a tank is typically prepared with an integrated boss of alloyed steel, to which feed-throughs are welded or bolted.

In Patent Publication U.S. Pat. No. 6,339,996 B1 it is described that comparable composite pressure tanks can result in a weight saving of up to 70% relative to steel tanks. In said patent publication, a vessel having such composite tanks is described. The tanks are arranged vertically aligned in the vessel, the tanks being arranged vertically standing in three heights inside the hull of the vessel. This results, however, in stability problems if the upper layer of tanks contains significant quantities of liquid, while the lower layer of tanks mainly contains gas. Therefore, a complex system of manifolds, lines, valves and connections, is arranged in said vessel. The tanks and the comprehensive pipe system according to said publication are arranged in a closed space inside the vessel. Repair or replacement of damaged tanks or components within the closed space is very laborious and expensive.

A demand exists for a vessel for transport of compressed natural gas or combination of gas and liquid, which vessel is preferable relative to the above-mentioned problems.

SUMMARY OF THE INVENTION

The above-mentioned demand is met by the present invention providing a vessel comprising a number of composite storage tanks for transport of compressed natural gas (CNG) or a combination of gas and liquid, which tanks have an elongated, cylindrical intermediate section and a lower end and an upper end, the tanks being arranged side-by-side vertically standing in the vessel, distinguished in that the hull, the bulkheads and the deck of the vessel form a closed space enveloping all tanks except from the upper end of each tank or selected tanks, for which tanks the upper end extends sealingly out of the closed space, all feed-throughs (bushings, sockets) in the tanks with couplings for loading and unloading are outside of the closed space, at the upper end of the tanks, and the tanks are supported (suspended) such that each tank can expand or contract freely within the operating range of the tanks with respect to pressure and temperature.

FIGURES

The invention is illustrated with six figures, of which:

DETAILED DESCRIPTION

The storage tanks in the vessel according to the invention are elongated, vertically standing tanks of height 10-40 m, typically 30 m, and diameter of 2-6 m, typically 3 m. The elongated midsections of the tanks have the form of a cylinder, preferably of circular cross-section. An inner wall limits gas diffusion through the tank wall, which inner wall preferably is prepared from a thermoplastic polymer material, for example HDPE. Around the inner wall glass- or carbon fiber is wound, which fibers have adhesive material or hardening material applied, for example epoxy, and the fibers have been wound with a pre-tensioning, such that the inner wall section is in compression. The upper and lower end of the tanks are generally formed as half-spheres, with an integrated end-boss of low-temperature stable steel, preferably austenitic stainless steel. Such tanks are previously known, and it is also known that such tanks are exposed to significant strain because of relatively low elasticity module for the material from which the tanks are built, which has limited the use of large composite storage tanks in vessels. By the support, suspension and arrangement of tanks and couplings according to the present invention, the possibility for expansion-/contraction is maintained even for large composite tanks, and the arrangement of connection and disconnection outside a closed space facilitates installation, maintenance, replacement and connection and disconnection of tanks to a significant extent.

The vessel according to the invention contains tanks extending from or at the bottom of the vessel to above open deck level on the vessel. The tanks are generally fixedly supported or suspended in one end, and can expand freely in the other end, and radially in the horizontal plane, within the operating range of the tanks with respect to pressure and temperature. Generally, also the free ends of the tanks are supported such that the tanks will not experience horizontal displacements when the vessel is moving. Normal operating pressure for the tanks is generally in the range of 150 to 300 bar, typically about 250 bar, but lower pressure is useful, and higher, by adapting the extent of fiber armouring. The operating temperature for the tanks is normally from −60° C. to +60° C., but both lower and higher temperatures can be relevant.

For a further description of the tanks with the actual pipe arrangement and the arrangement thereof on the vessel, reference is made to the figures.

Figure 1:
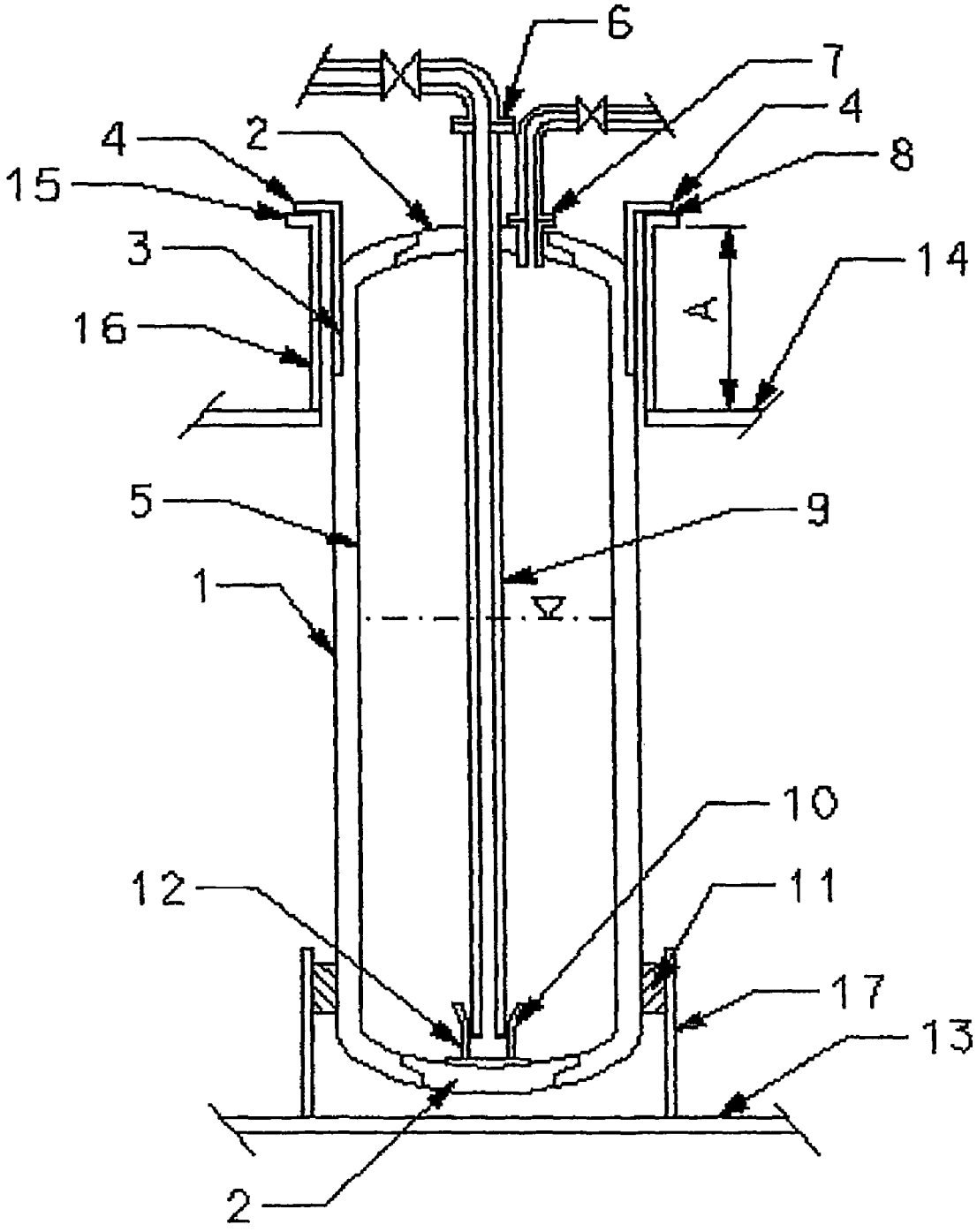
FIG. 1 illustrates a tank in a vessel according to the invention, the tank being freely suspended above deck and having free expansion towards the bottom of the vessel.

FIG. 1 illustrates a tank 1 that is fixedly suspended above the deck 14 of the vessel in the upper end, and is hanging freely and can thereby expand freely towards the bottom 13 of the vessel. The deck level 14 of the vessel lies open to the surroundings. For each tank an extension socket 16 having larger internal diameter than the outer diameter of the tank, is arranged from the deck of the vessel. The socket 16 extends a distance A above the deck level and ends with an outward extending flange 15. The tank of FIG. 1 is equipped with a skirt 3 in the upper end, with an outward extending flange 4 having a diameter larger than the inner diameter of the socket, with sealing material 8 between said flanges 15, 4, as the tank can be hung up directly on the socket with sealing material in between. The lower end hangs freely inside a guiding pipe 17 having diameter larger than the tank, with a flexible side support 11 arranged between the tank 1 and the pipe 17. Internally in the pipe 17 a collecting tray is arranged that hinders any cold, dripping liquid from the end-boss 2 of the tanks from getting into contact with the steel structure of the vessel. A bolted port can be installed on said end-boss. The tank 1 further comprises an end-boss 2 also in its upper end, to which a flange 6 for liquid pipe and a flange 7 for gas pipe are arranged. An internal tank pipe 9 is arranged to the flange 6 for liquid pipe, which internal tank pipe 9 is brought down to and into a guiding means 10 that hinders horizontal movement, and the guiding means 10 is perforated 12 to ensure free flow of gas and liquid. Internally in the tank is also a gas-tight inner wall 5, a so-called liner. An optional liquid level is indicated in the tank.

Figure 2:
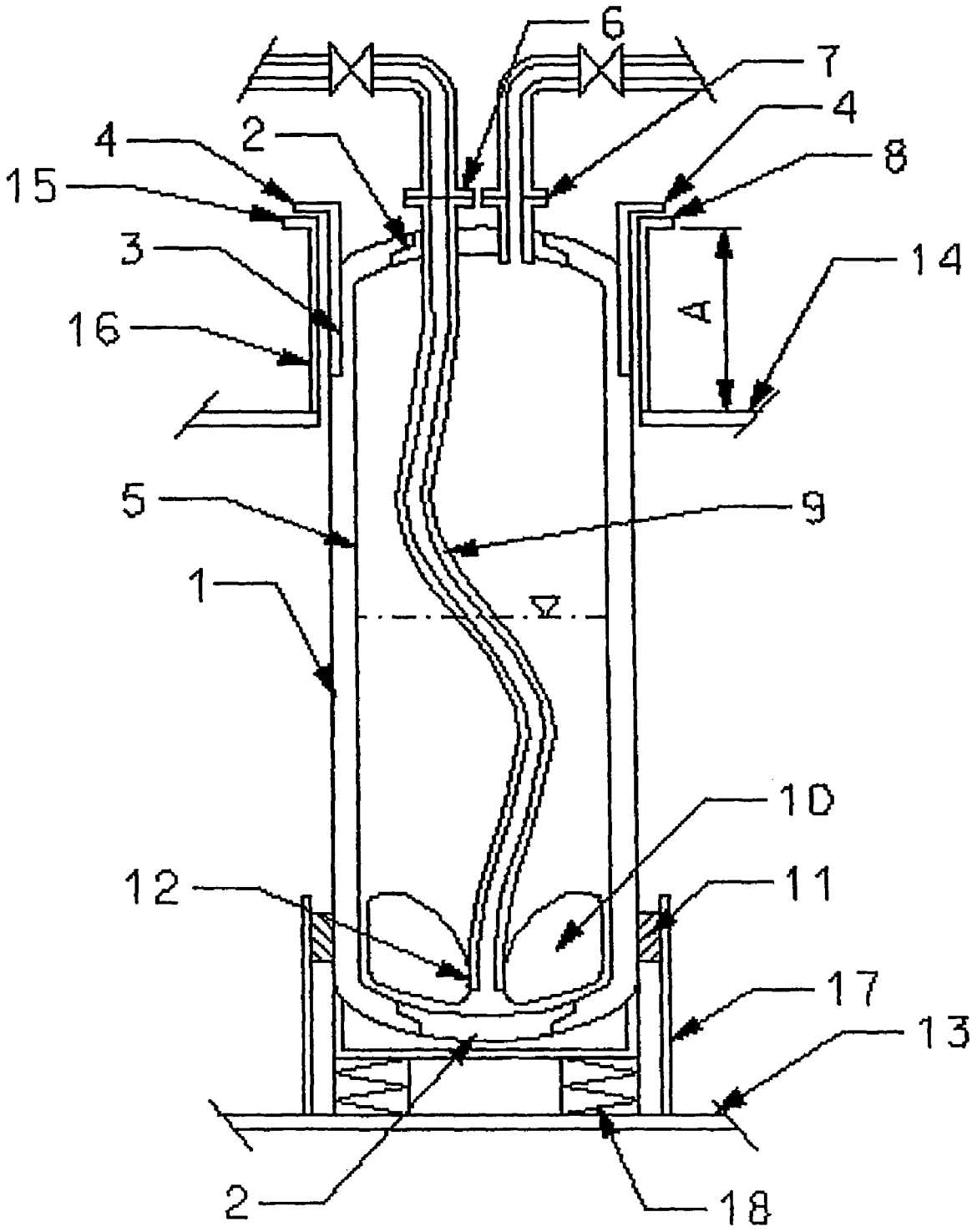
FIG. 2 illustrates a tank in a vessel according to the invention, which tank is freely suspended above deck, and has a resilient support in the bottom.

FIG. 2 illustrates an identical tank, except from a skirt arranged at the lower end of the tank, and a resilient support 18 is arranged between the bottom of the vessel 13 and a fundament in the skirt of the tank at its lower end. The embodiment illustrated on FIG. 2 is more preferable than the embodiment illustrated on FIG. 1, if liquid should possibly occur in the tanks, as a part of the weight of the tank will be taken up by the resilient support. Identical or corresponding elements are in FIG. 2 and subsequent figures indicated by the same reference numericals as for FIG. 1.

Figure 3:
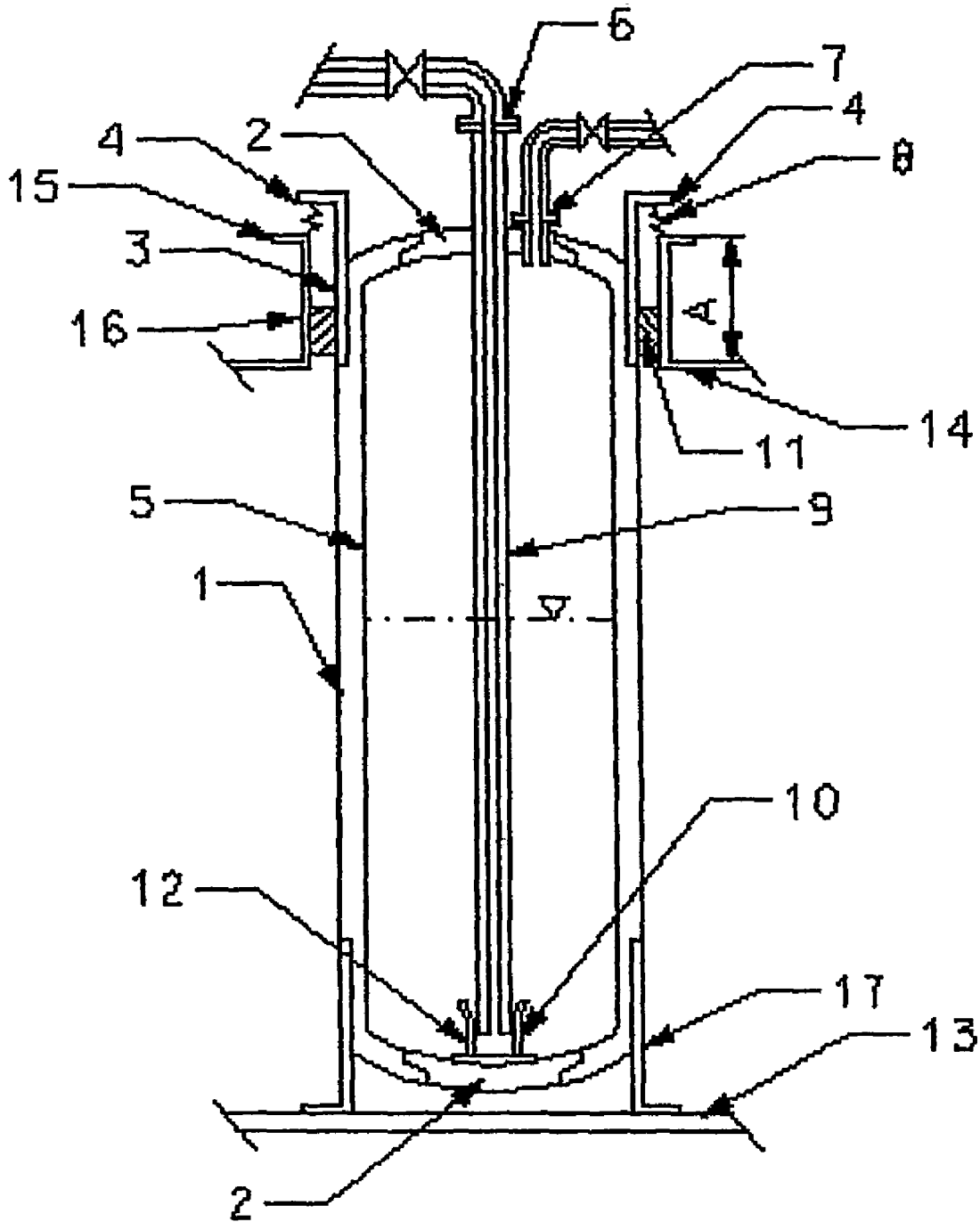
FIG. 3 illustrates a tank in a vessel according to the invention, which tank is fixedly supported against the bottom and has a flexible sealing above deck.

FIG. 3 illustrates an alternative and more preferred embodiment of a tank in a vessel according to the invention. The tank is fixedly supported against the bottom, preferably in a complementary formed receiving part on the bottom, optionally the tank is equipped with a skirt 17 in its lower end, which skirt rests directly on the bottom 13 of the vessel. In the upper end a flexible sealing 8 is arranged, to seal and take up strain of the tank in longitudinal direction. The flexible sealing 8 is for example in the form of a bellow or a spring with packer or seal collar. Any liquid in the tank will thereby not be carried by the above wall section of the tank.

Figure 4:
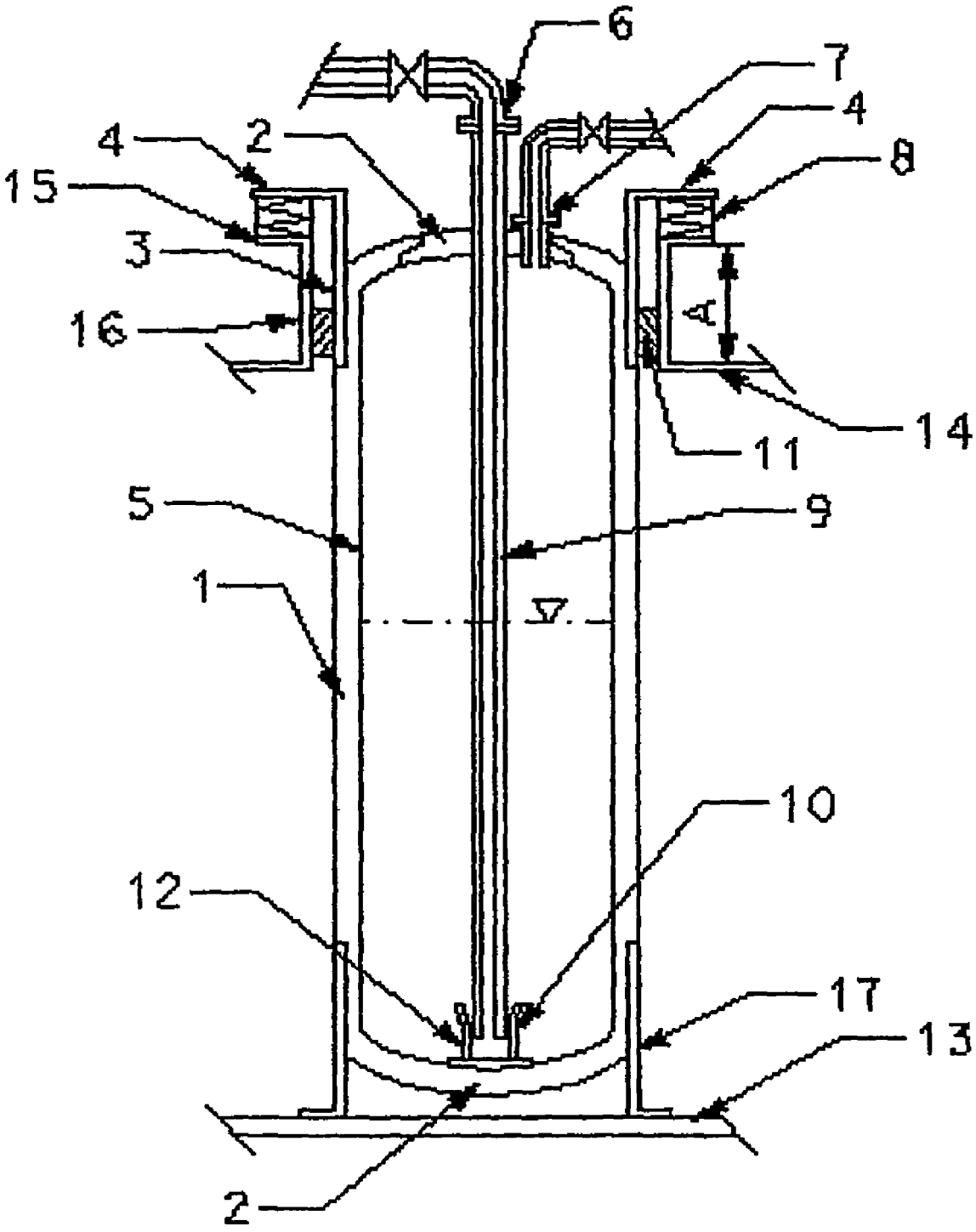
FIG. 4 illustrates a tank in a vessel according to the present invention, which tank is resiliently suspended above deck level.

The embodiment illustrated on FIG. 4 is similar to the embodiment illustrated on FIG. 3, except that it has a resilient suspension at the top of the tank.

Figure 5:
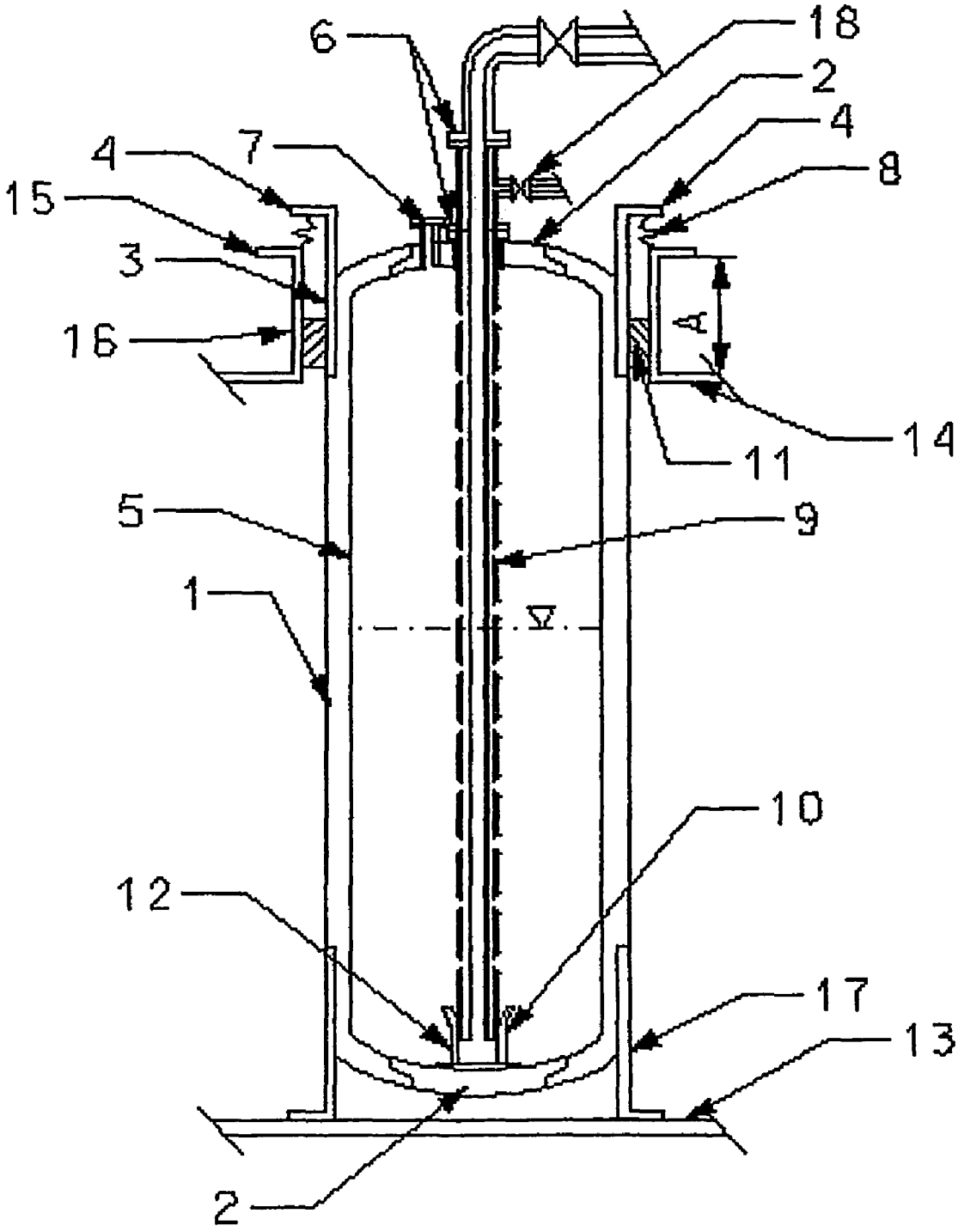
FIG. 5 illustrates a tank in a vessel according to the present invention, which tank is fixedly supported in the bottom and has an internal concentric double pipe.

An even more preferred embodiment of a tank in a vessel according to the invention is illustrated on FIG. 5. Even this tank 1 is fixedly supported against the bottom, and has resilient sealing at the upper end. The upper end extends a distance A up above the deck of the vessel. Said distance A can be adapted to the actual vessel. A hanging, concentric double pipe 9 is installed through the coupling or feed-through 6 in the tank hatch in the upper end of the tank. The concentric design gives the double pipe sufficient stiffness to avoid unwanted movements and vibrations during operation. The concentric double pipe, which preferably is made of light and durable material, has the same design life as the tank. In the lower end the double pipe is brought down into a guiding means 10 adapted such that the pipe can move when the tank is expanding, which guiding means also functions as a collection bin or funnel to ensure effective unloading of the tank. The guiding and funnel means 10 can be fastened to a bolted hatch that is installed from the outside when the inner pipe 9 is in place in the tank. The inner of the concentric pipes 9 will preferably be used for loading and unloading/draining of any liquid in the tank. The outer of the concentric pipes 9 is preferably perforated and can have holes of increasing diameter in upward direction, which during unloading of the tank will ensure that lighter and heavier components (liquid) are mixed. This outer pipe can be used for gas draining and/or internal flushing of the inner surfaces of the tanks to ensure that over the time no unwanted fouling builds up on the inside of the tanks. Similarly as for the other embodiments, a composite tank 1, with end-boss 2 and tank skirt 3 is illustrated on FIG. 5. The tank skirt 3 has a flange 4 in its upper end. The tank wall comprises an inner part 5 that is diffusion proof. As mentioned, a flange 6 for connection of the pipe 9, and further a flange 7 for lowering of inspection equipment, are illustrated. An expansion- and sealing device 8 is arranged between the socket 16 and the tank flange 4. The most preferable form of the invention is a vessel with a number of tanks supported and equipped as illustrated on FIG. 5.

Figure 6:
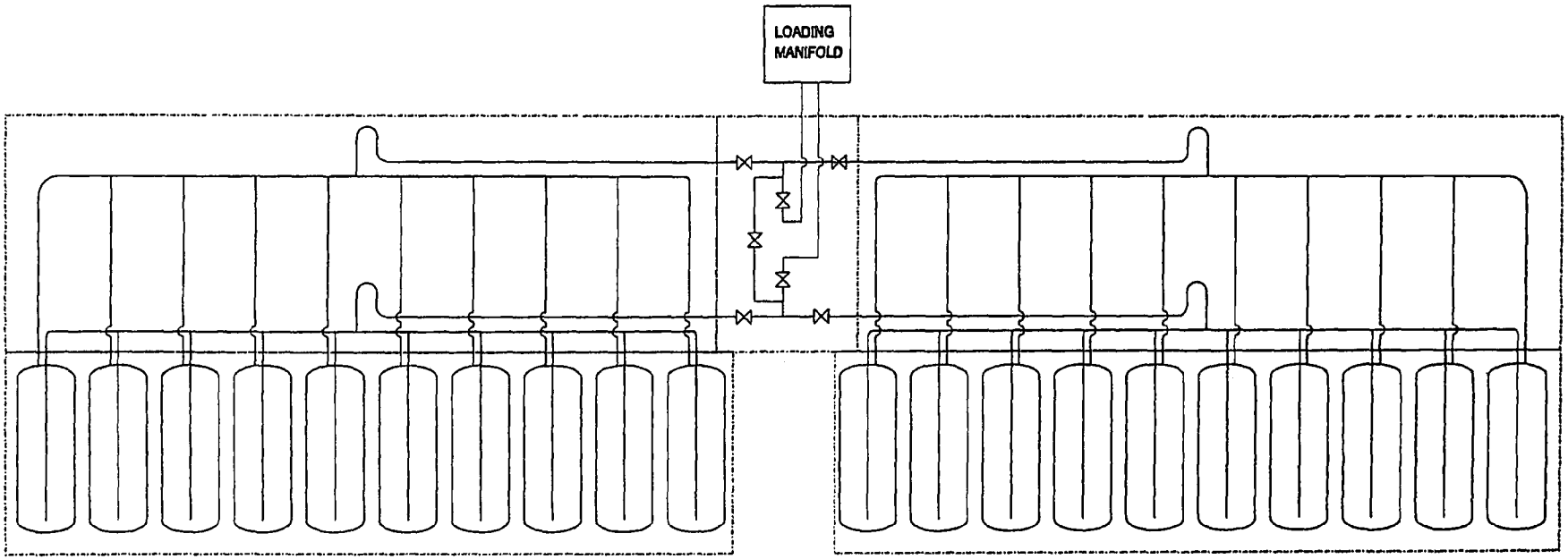
FIG. 6 illustrates a pipe arrangement in a vessel according to the invention.

FIG. 6 illustrates a pipe arrangement on a vessel according to the invention, where all pipe feed-throughs are at the top or in the upper end of the tank. Crossover-connections with valves are arranged between the manifolds, to facilitate flushing of the pipe arrangement with inert gas, and the whole assembly, with illustrated pipes and valves, and further optional elements, is arranged in an open area at deck level on the vessel.

Any liquid that is formed in the tanks or is carried to the tanks, will collect in the lower end of the tanks, such that the stability of the vessel will not be unfavorably affected. Optionally, a feed-through can be arranged also in the lower end of the tanks, for draining of liquid. The tanks are preferably arranged along the center-line of the vessel and symmetrically around the center-line of the vessel. Preferably, separate ballast tanks are arranged outside the storage tanks, between the side walls of the vessel and the storage tanks. The closed volume will be equipped with gas detectors, and during operation it will preferably be filled with inert gas.

The invention claimed is:

1. A vessel comprising a number of storage tanks for transport of compressed natural gas (CNG) or a combination of gas and liquid, the tanks having an elongated, cylindrical intermediate section and a lower end and an upper end, the tanks being arranged side-by-side vertically standing in the vessel, wherein the tanks are made of a polymeric composite material with a lining of a thermoplastic material at an inner wall of the tanks as a diffusion barrier, wherein a hull, bulkheads and a deck of the vessel form a closed space enveloping all of the tanks except from the upper end of each tank or selected tanks, such that the upper end extends sealingly out of the closed space, wherein all feed-throughs in the tanks with couplings for loading and unloading are outside of the closed space, at the upper end of the tanks, and wherein the tanks are supported such that each tank can expand or contract freely within an operating range of the tanks with respect to pressure and temperature.

2. The vessel according to claim 1, wherein each tank has a height of about 30 m and a diameter of about 3 m, and half-sphere-formed upper and lower ends.

3. The vessel according to claim 1, wherein each tank extends in a vertical direction from the bottom of the vessel to a deck level or above the deck level.

4. The vessel according to claim 1, wherein the storage tanks are fixedly supported in the lower end thereof.

5. The vessel according to claim 1, wherein all manifolds, valves and connections for loading and unloading of the tanks are outside the closed space, in an open area at a deck level on the vessel.

6. The vessel according to claim 1, wherein a concentric and multi-functional double pipe with a perforated outer pipe extends down to the bottom of each tank for loading, unloading and flushing of an inner surface of the tank, respectively.

7. The vessel according to claim 1, wherein the storage tanks are single-standing and each tank can be replaced by lifting each tank up vertically from the vessel through a socket extending up above deck level of the vessel.

8. The vessel according to claim 1, wherein the tanks have resilient, flexible sealing in the upper end, for sealing between the closed space and a deck level.

9. The vessel according to claim 1, wherein thermoplastic material at the inner wall of the tanks is high-density polyethylene (HDPE) as the diffusion barrier to limit gas diffusion through the inner wall of the tanks.

* * * * *